US010731320B2

(12) United States Patent
Radnich

(10) Patent No.: US 10,731,320 B2
(45) Date of Patent: Aug. 4, 2020

(54) SLURRY SLED FOR FILLING TRENCH HOLES

(71) Applicant: Micah Radnich, Ontario, CA (US)

(72) Inventor: Micah Radnich, Ontario, CA (US)

(73) Assignee: HHS Construction Inc., Ontario, CA (US)

( * ) Notice: Subject to any disclaimer, the term of this patent is extended or adjusted under 35 U.S.C. 154(b) by 0 days.

(21) Appl. No.: 16/212,249

(22) Filed: Dec. 6, 2018

(65) Prior Publication Data

US 2020/0181877 A1 Jun. 11, 2020

(51) Int. Cl.
*E02F 5/12* (2006.01)

(52) U.S. Cl.
CPC ..... *E02F 5/12* (2013.01)

(58) Field of Classification Search
CPC ..... E02F 5/12
USPC ..... 37/142.5
See application file for complete search history.

(56) References Cited

U.S. PATENT DOCUMENTS 801,240 A * 10/1905 Hively ..... E02F 5/223 37/142.5
2,160,193 A * 5/1939 Arndt ..... E02F 3/7672 172/783
2,480,256 A * 8/1949 Nurenberg et al. ..... B62B 13/18 280/9
2,989,314 A * 6/1961 Larson ..... A01O 17/00 239/683
3,603,097 A 9/1971 Zakiewicz
4,028,902 A 6/1977 Courson et al.
4,050,261 A 9/1977 Brewer et al.
4,129,992 A 12/1978 Carlsson et al.
4,130,953 A * 12/1978 Bruno ..... E01H 5/02 280/47.26
4,290,246 A 9/1981 Hilsey
6,478,508 B1 11/2002 Magnani et al.
2009/0302065 A1* 12/2009 Winsor ..... B61D 7/32 222/236

FOREIGN PATENT DOCUMENTS

GB 1244400 A * 9/1971 ..... E02F 5/102
GB 2535199 A * 8/2016 ..... E02F 5/103

* cited by examiner

*Primary Examiner* — Tara Mayo-Pinnock
(74) *Attorney, Agent, or Firm* — Kirk A. Buhler; Buhler & Associates Patenting

(57) ABSTRACT

Improvements in a backfilling sled is disclosed the slurry sled for filling trench holes is pushed or pulled and receives a poured, flow-able medium such as sand or cement for example. The slurry sled self-centers itself over a trench dug or cut in various road or ground surfaces such as concrete or asphalt. The poured flow-able medium enters the top of the unit and flows through the bottom into a trench cut to a specific width and depth as it backfills and levels the backfill material to an evens surface to restore the road or ground surface.

20 Claims, 4 Drawing Sheets

SLURRY SLED FOR FILLING TRENCH HOLES

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a trench filling machine. More particularly, the present slurry sled for filling trench holes or elongated slots. The slurry sled is configured to be pulled by a delivery truck to evenly backfill and trowel the backfill material even with a road surface without human interaction.

Description of Related Art Including Information Disclosed Under 37 CFR 1.97 and 1.98

To install an underground cable a narrow and deep trench is cut deep through a road or other surface. The trench is usually over a foot deep, but can be several feet deep and is usually only several inches wide. The removed material is typically discarded because the properties are a mixture of different materials with unknown properties. A cable, pipe or other item is deposited on the bottom of the deep trench. After testing the narrow trench must be backfilled. The narrow width and deep trench make back-filling a challenge. Conventional methods for refilling a trench cut are laborious utilizing multiple laborers with shovels which is time consuming. They typically involve pouring a backfill material in the proximity of the narrow groove where one, or usually multiple, workers push the material into the slot.

A number of patents and or publications have been made to address these issues. Exemplary examples of patents and or publication that try to address this/these problem(s) are identified and discussed below.

U.S. Pat. No. 4,028,902 issued on Jun. 14, 1977 to Thomas G. Courson et al., and is titled P Apparatus for laying elongated flexible tubing. The patent discloses an apparatus for laying elongated, flexible tubing in a trench and adapted to be secured to a trenching boom carried by a vehicle. A first partition is adjacent the forward end and defines a flexible tubing tunnel, the tunnel opening to the top and bottom of the hopper so that flexible tubing may enter the top of the hopper and exit the bottom thereof behind the trenching boom. A second partition is located in the hopper rearwardly of the first partition and defines first and second fill receiving compartments. The compartments open upwardly to receive fill material such as sand, and downwardly to release fill material rearwardly of the tunnel. The second compartment opens downwardly at a level above the downward opening of the first compartment and a first compactor is carried by the hopper rearwardly of the first compartment and forwardly of the second compartment for compacting fill released from the first compartment. A second compactor is carried by the hopper rearwardly of the second compartment for compacting fill material released from the second compartment. This patent just provides fill material into the trench but does not disclose finishing the road or surface.

U.S. Pat. No. 6,478,508 issued on Nov. 12, 2002 to Magnani; Francesco Magnani and is titled Apparatus for laying underground electric cables. This patent discloses an apparatus for laying underground electric cables. A first van is a guide structure engaging the cable for laying it on the base layer previously compacted by a vibrating plate. A second van carries a second deposition unit forming a covering layer of inert material upon the previously laid-down base layer and cable. While this patent discloses laying inert material over a cable it does not address applying a finished material that is level with the street or road surface.

What is needed is a mechanism that finishes the trench to a surface that matches the surrounding topography. The slurry sled for filling trench holes disclosed in this document provides the solution with a sled that top filled and flows into the trench with a finishing trowel that provides a smooth, even and finished surface.

BRIEF SUMMARY OF THE INVENTION

It is an object of the slurry sled for filling trench holes to quickly and efficiently receive cement such as a slurry mix or other flow-able medium in large volumes and direct it into a chute type device that specifically fills a trench at a fast rate and thereby reduces labor efforts normally associated with refilling a trench cut.

It is another object of the slurry sled for filling trench holes for medium to be placed into the trench requiring filling at a high volume thus reducing labor efforts and increasing production which accelerates job completion. The slurry sled for filling trench holes is specifically directing fill medium into the trench it reduces the amount of wasted material and potential clean up normally associated to current known methods of trench filling.

It is another object of the slurry sled for filling trench holes to be pushed from behind either manually or by a device such as powered construction equipment. It is also designed for the function of being tethered from the front to a piece of equipment. In this orientation the slurry sled can follow at the same rate of speed as the device supplying the fill medium for the trench to be filled such as a cement truck.

It is another object of the slurry sled for filling trench holes to have a removable multi functioning removable chute that is designed to both center the unit over the trench-cut during operation as well as specifically funnel the medium into the trench at pre-fabricated depths and widths. The multi functioning removable chute is removable it can be taken out for cleaning, stowage and modularity being interchanged for chutes of different configurations as needed for different trench fill needs. The removable chute device sits into the bottom neck part of the trough and fixed into place allowing small movements as the device travels along. The chute fixes into place but has slight movement allowances, it continuously self-centers and adjusts without coming loose from the bottom of the trough. This allows for a less rigid, more forgiving and less damage.

It is another object of the slurry sled for filling trench holes to have a front "L" with a large robust guide. This front interchangeable guide pin piece hinges on barrel pin hinges. This hinging guide pin is able to lock into two positions where it can be lowered into the trench and centers over the trench. The guide pin is modular and removable as well as stow-able in the up position. The front guide is configurable and tailored to the different trench fill widths. The guide pivots up and out of the trench when not in use and down into position when it is in use.

It is another object of the slurry sled for filling trench holes to have wheels that allow for easy movement of a loaded trough and during irregular rough terrain the skids are able to ramp up and over obstacles such as speed bumps, root damaged roads and ground surface as well as cracks and generally rough surfaces. This aids in smooth constant forward motion of the slurry sled. The wheeled design features removable, grease-able wheels.

It is still another object of the slurry sled for filling trench holes to have mounting for a concrete vibrator to be placed into the lower chute part of the trough to aid in medium flow and compaction. A slurry sled can also have a multifunction platform that can be used to mount a small electrical generator to power a concrete vibrator or to be used as a general tool basket for chains or other items.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
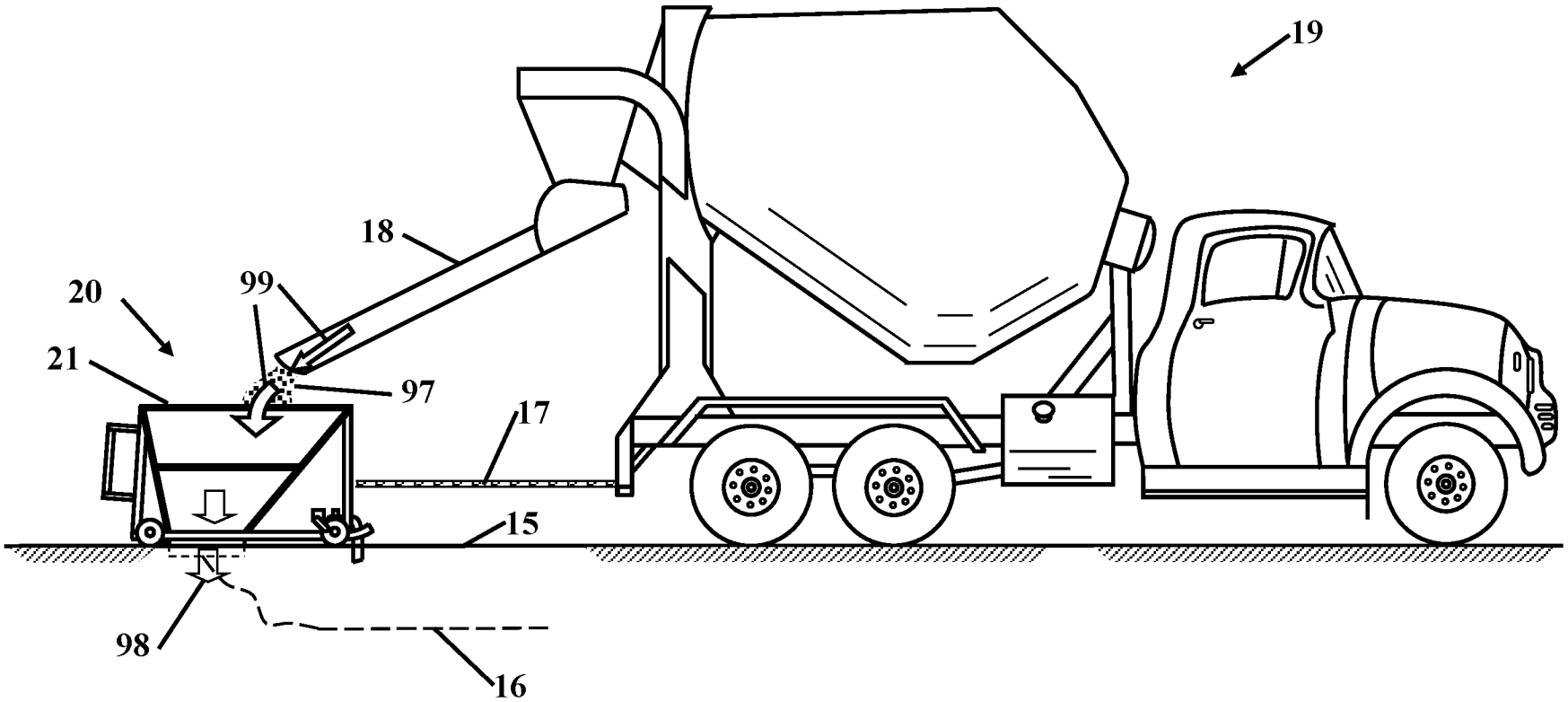
FIG. 1 shows a slurry sled for filling trench holes.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

15 road surface
16 trench
17 rope, cable or chain
18 chute
19 cement truck
20 slurry sled
21 receiving tank
22 vibrator mount
23 front tow hooks
25 skid
26 lock pin
27 push bar
28 rear tow hook
30 troweling wing
31 wheel(s)
40 funnel chute
41 guide tube
42 bottom opening
43 top surface
44 nose
45 rear taper
46 hook
47 bottom surface
50 guide assembly
51 "L" or "V" guide
52 barrel pin pivot tube
53 cross joiner
54 pivot axis
55 stop
60 wheel(s)
71 multifunction platform
72 generator
96 forward
97 fill material
98 fall
99 pour FIG. 1 shows a slurry sled 20 for filling trench holes or elongated slot. The slurry sled 20 for filling trench holes is configured as being pushed from behind either manually or by a device such as powered construction equipment such as a cement truck 19. In this figure the slurry sled 20 is being tethered with a rope, cable or chain 17 from the front of the slurry sled 20 where it is being towed by the cement truck 19. In this orientation the slurry sled 20 can follow at the same rate of speed as the cement truck 19 is supplying the fill medium from the chute 18 and pours 99 from the cement truck 19 for the trench 16 to be filled such as a cement truck 19. The fill material 97 pours from the cement truck 19 into the slurry sled 20 where it is held in the receiving tank 21. The fill material 97 can be cement, sand, gravel, dirt or aggregate. The fill material 97 collects in the receiving tank 21 and is funneled through the bottom of the receiving tank 21 and falls 98 or pours out of the bottom of the slurry sled 20 and into the trench 16. The fill material 97 fills the void narrow void of the trench to a level that matches or follows the road surface 15.

Figure 2:
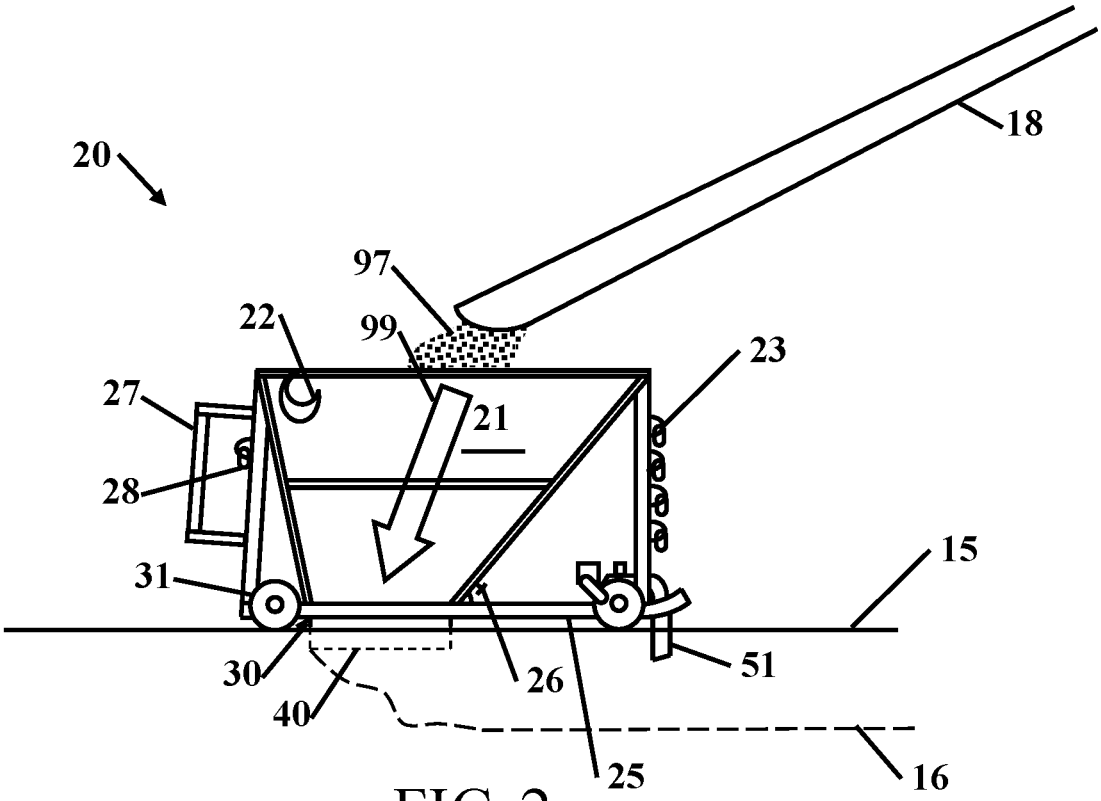
FIG. 2 shows a side view of the slurry sled.

FIG. 2 shows a side view of the slurry sled. This slurry sled 20 has a removable multi functioning device designed to both center the unit over the trench 16 that is cut during operation as well as specifically funnel the fill material 97 into the trench 16 at pre-fabricated depths and widths. Because the funnel chute 40 is removable it can be taken out for cleaning, stowage and modularity being interchanged for funnel chutes 40 of different configurations as needed for different trench fill needs. Typically, the different configurations are for different widths of the funnel chute to accommodate different widths of a trench. The width of the trench is typically a function of the cable or pipe that is laid or set into the bottom of the trench 16. The removable funnel chute 40 is shown in other figures herein.

Fill material 97 is poured into the receiving tank 21 where it accumulates to create a head weight of material to forcibly push the fill material 97 into the trench 16 to completely fill the trench 16 to the top of the road surface. The rear of the slurry sled 20 has a troweling wing 30 that levels off the fill material 97 at the level surface of the road surface. This restores the road surface without any additional processing if the fill material 97 at the road surface 15. It allows for a continuous pour 99 from the cement truck and only requires monitoring of the cement pool within the receiving tank 21. On the sides of the upper lip of the receiving tank 21 trough are mounting points for a concrete vibrator mount 22 to be placed into the lower chute part of the trough to aid in medium flow and compaction.

The slurry sled 20 has a vibrator mount 22 to provide agitation to the fill material 97 to prevent clumping of the fill material 97 to allow for smooth and even flow of the fill material 97 out of the funnel chute 40.

The front of the slurry sled 20 has one or a plurality of front tow hooks 23. To retain and track the slurry sled 20 in the trench 16 the slurry sled 20 has a front guide assembly 51 that guides the front of the slurry sled 20. The funnel chute 40 tracks the middle or rear of the slurry sled 20 so the slurry sled 20 remains true in the trench 16. The front guide assembly 51 is configurable with the funnel chute 40 to match the width of the trench 16.

The plurality of front tow hooks 23 allow the connection from the slurry sled 20 to the tow vehicle as a linear connection to prevent lifting the slurry sled 20 with the tow vehicle or pulling the slurry sled 20 down into the road surface 15. The slurry sled 20 includes a skid 25 for the slurry sled 20 to slide over irregular road surfaces. The slurry sled 20 further includes a lock pin 26 for retaining the funnel chute 40 in the bottom of the receiving tank 21. The rear of the slurry sled 20 has a push bar 27 to push the slurry sled 20, as opposed to towing the slurry sled 20 behind a vehicle. Pushing the slurry sled 20 allows for dispensing a balance of fill material out of the receiving tank 21 when the vehicle that supplies fill material is empty or has driven away. The slurry sled 20 also has a rear tow hook 28 to tow the slurry sled 20 from behind.

On the front of the slurry sled 20 are multiple tethering points 23 spaced evenly at specific points. The purpose of these mounting points is to maintain correct placement of the tether; such as a chain, cable, rope, or strap that is attached to the pulling equipment or apparatus in front of it. This allows the pulling equipment or apparatus to pull the slurry sled 20 while it maintains solid contact with the ground without pulling the front of the ground or adding pressure to the front contact surface.

Figure 3A:
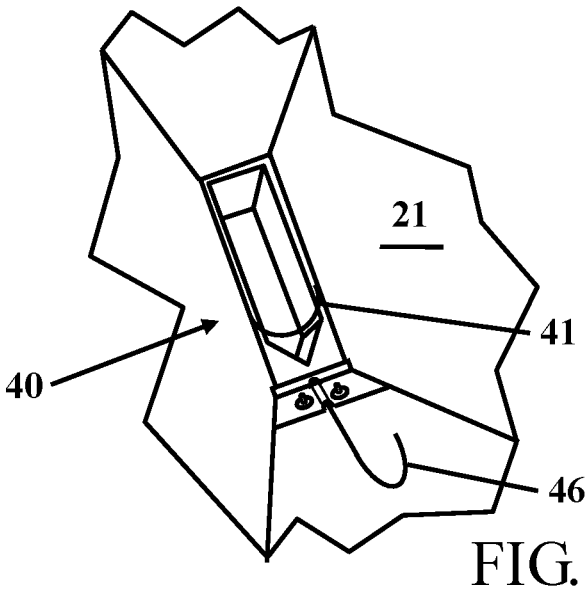
FIG. 3A shows the removable chute 40 in the bottom of the receiving tank.

FIG. 3A shows the removable chute 40 in the bottom of the receiving tank 21. This removable funnel chute 40 device sits into the bottom neck part of the trough or receiving tank 21 and is fixed into place allowing small movements as the slurry sled 20 travels along within a trench. The removable funnel chute 40 is compliantly mounted or fixed into place and has slight movement allowances, the removable chute 40 continuously self-centers and adjusts without coming loose from the bottom of the receiving tank 21. This allows for a less rigid, more forgiving and less damaging design. The removable funnel chute 40 has a hook 46 and a guide tube 41 that helps guide fill material that enters the removable funnel chute 40 and prevents the fill material from clumping and clogging the fill material that enters the removable funnel chute 40.

Figure 3B:
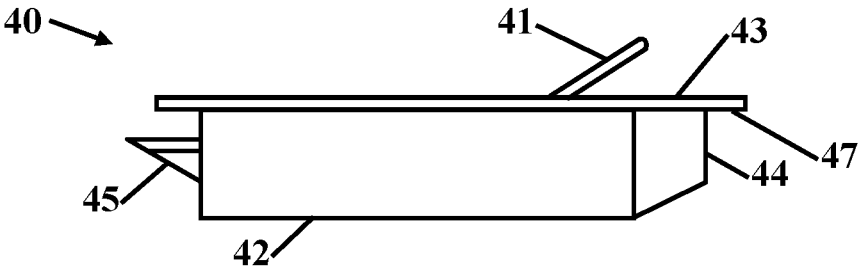
FIG. 3B-3E show different images of a preferred embodiment of a removable chute.
Figure 3C:
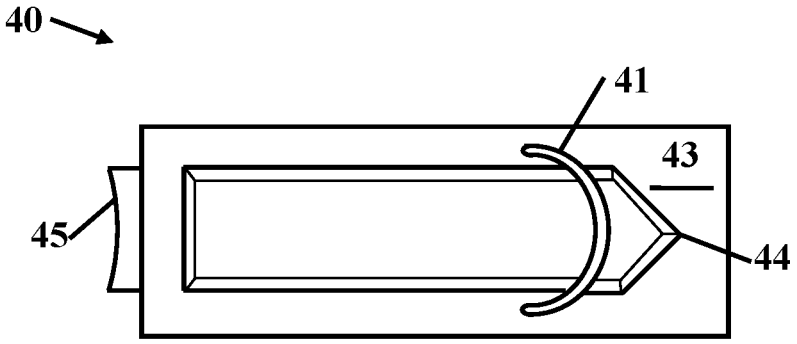
Figure 3D:
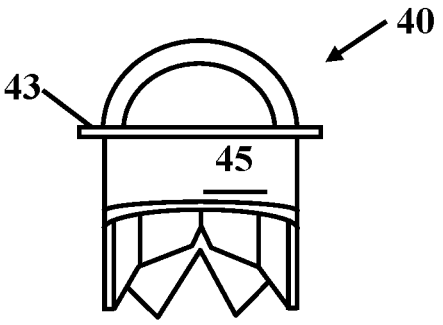
Figure 3E:
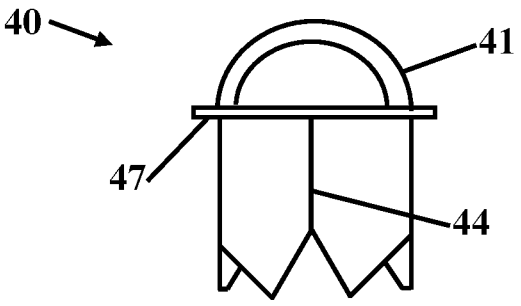

FIG. 3B-3E show different images of a preferred embodiment of a removable chute 40. FIG. 3B is a side view, FIG. 3C is a top view, FIG. 3D is a rear view and FIG. 3E is a front view. The removable funnel chute 40 is structured with a front plow or nose 44. The nose 44 is placed at or below the road surface and the nose helps guide the slurry sled 20 in the trench 16. The removable funnel chute 40 has a top surface 43 and a bottom surface 47. The top surface 43 is exposed to the fill material 97. The underside or bottom surface 47 of the removable funnel chute 40 is placed in contact with the receiving tank 21. These views show the lop of the guide tube 41 on the top of the removable funnel chute 40 and the bottom opening 42 where the fill material 97 passes through the removable funnel chute 40. The rear taper 45 fits under the receiving tank 21 and forward pressure on the nose 44 and the weight of fill material on the top surface 43 of the removable funnel chute 40 helps to maintain the removable funnel chute 40 within the receiving tank.

Figure 4A:
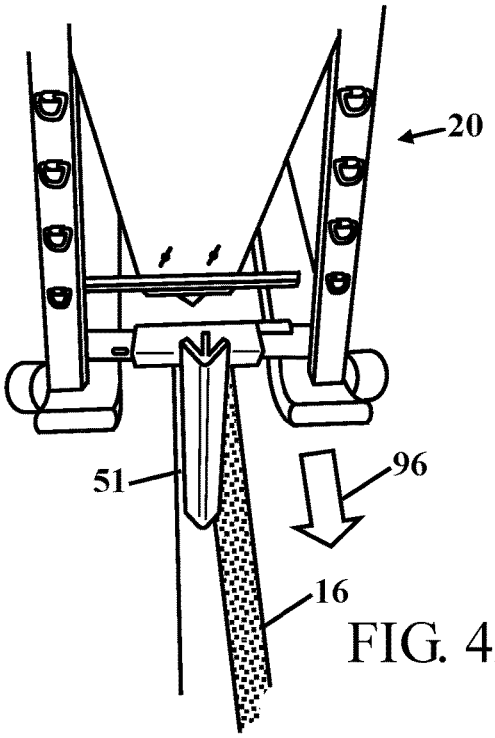
FIG. 4A shows the front guide in the slurry sled.
Figure 4B:
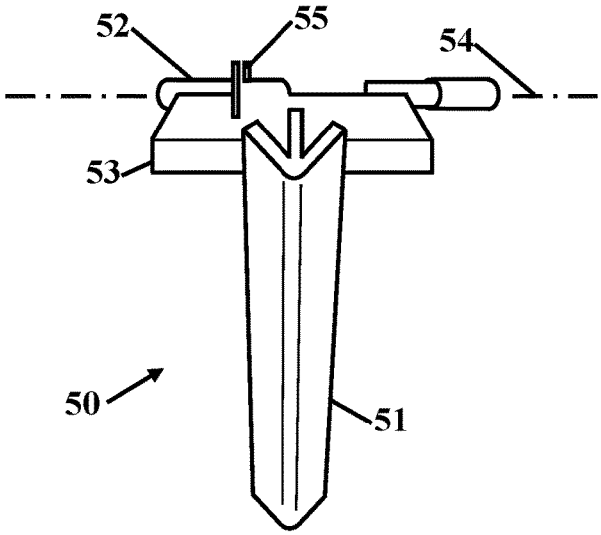
FIG. 4B shows the front guide removed from the slurry sled.

FIG. 4A shows the front guide in the slurry sled 20 and FIG. 4B shows the front guide removed from the slurry sled 20. At the front of the slurry sled 20 there is a mechanical guide assembly 50 that has an "L" or "V" guide 51 with a large, very robust guide on the front. This guide assembly 50 pin piece has an "L" or "V" guide 51 that is secured to a cross joiner 53 and then to a barrel pin pivot tube 52 that pivots through axis 54 on grease-able barrel pin hinges. This hinging guide pin is able to lock into two positions, up and down with stops 55. In the down position, the guide assembly 50 lowers into the trench 16 and centers the slurry sled 20 assembly over the trench 16 as the slurry sled 20 is moved forward 96 in the trench 16 that is to be filled. The "L" or "V" guide 51 is also modular and removable as well as stow-able in the up position. The "L" or "V" guide 51 interchangeable with other guides of similar but different designs according to the width of the trench and for as centering the leading side of the slurry sled 20 as it travels forward over the trench. Since this the "L" or "V" guide 51 is modular, each front guide piece can be configured and tailored to the different trench fill widths. It is stow-able for the purpose of transporting to and from trench cut locations. The guide pivots up and out of the trench when not in use and down into position when it is in use. In either the stowed or the lowered position, the centering guide locks with stops 55 into place.

Figure 5:
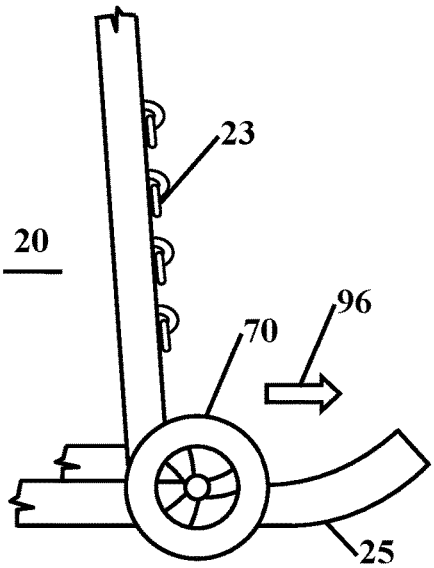
FIG. 5 shows a portion of the front of the slurry sled.

FIG. 5 shows a portion of the front of the slurry sled. The bottom of the slurry sled 20 consists of a wheeled 70 skid 25 bottom. The skids 25 have a front ramp ends on the front and wheel(s) 70 mounting to it, with two wheels in the front and two wheels in the rear. Over smooth regular terrain the wheels 70 allow easy movement of a loaded trough and during irregular rough terrain the skids 25 are able to ramp up and over obstacles such as speed bumps, root damaged roads and ground surface as well as cracks and generally rough surfaces as the slurry sled 20 is moved forward 96. The skids 25 aids in smooth constant forward motion of the slurry sled 20. The wheeled design features removable, grease-able wheels. The removable feature allows wheels to be replaced after wear or damage.

Figure 6:
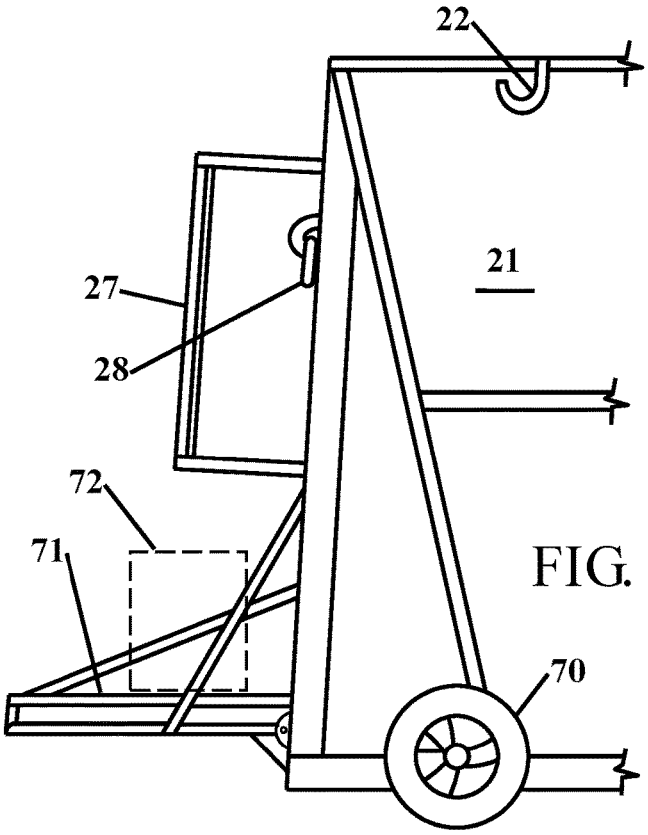
FIG. 6 shows a portion of the rear of the slurry sled.

FIG. 6 shows a portion of the rear of the slurry sled. At the rear of the device is a push bar type assembly that functions as an aid in control of the slurry sled 20 or to push from either by hand or by powered equipment or apparatus. There is a tethering anchor point/lifting point (similar to those mounted on the front for pulling) at mid-level on the rear up-right posts. From these points the slurry sled 20 is pushed with the push bar 27 or the slurry sled 20 can connect a tethering strap, cable, chain or rope for example so it maintains a steady, controlled space and speed so it cannot roll away if the terrain is un-level. The slurry sled 20 also has a rear tow hook 28 to pull or trailer the slurry sled 20.

On the sides of the upper lip of the receiving tank 21 trough are mounting points for a concrete vibrator mount 22 to be placed into the lower chute part of the trough to aid in medium flow and compaction. On the lower portion in the rear of the slurry sled 20 is a multifunction platform 71 that can be used to mount a small generator 72 or be used as a general tool basket for chains or other items. It can support a small generator for the purpose of powering a concrete vibrator and be completely self-contained without relying on another power source.

Thus, specific embodiments of a slurry sled for filling trench holes have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A slurry sled for filling trench holes comprising:

a sled having a receiving tank that is configured to accumulate fill material;

said receiving tank is supported on a plurality of wheels that are configured to roll on a street or road;

said receiving tank has an elongated bottom opening;

said bottom opening having an opening that is configured to terminate below said street or road within an open trench hole;

said sled includes an "L" or "V" guide that is configured to terminate below said street or road in front of said receiving tank;

said sled has a tow mechanism whereby said sled is configured to be towed behind a vehicle that dispenses said fill material within said receiving tank, and said sled has a troweling wing that is configured to level fill material that is dispensed from said elongated bottom opening to be essentially even with a top surface of said street or road.

2. The slurry sled for filling trench holes according to claim 1, wherein said fill material is selected from a group consisting of cement, sand, gravel, dirt and aggregate.

3. The slurry sled for filling trench holes according to claim 2, wherein said fill material fills a void within said open trenched hole.

4. The slurry sled for filling trench holes according to claim 2, wherein said sled has at least one fixed hook or loop and guide tube within said receiving tank that is configured to guide said fill material that enter a removable funnel chute to break-up said fill material before said fill material enters said bottom opening.

5. The slurry sled for filling trench holes according to claim 2, wherein said sled has at least one hook and at least one loop that breaks-up fill material that passes into a removable funnel chute before said fill material enters said bottom opening.

6. The slurry sled for filling trench holes according to claim 2, further includes a mount for a vibrator that is configured to agitate said fill material.

7. The slurry sled for filling trench holes according to claim 1, wherein said sled further includes has at least two skid rails.

8. The slurry sled for filling trench holes according to claim 7, wherein said skid rails are configured to ride over anomalies of said street or road.

9. The slurry sled for filling trench holes according to claim 7, wherein said skid rails have at least one end that is curved.

10. The slurry sled for filling trench holes according to claim 1, further includes a front guide that is configured with a first position that terminates at an end of said front guide below said street or road.

11. The slurry sled for filling trench holes according to claim 1, that further includes a front guide that is configured to pivot on said sled.

12. The slurry sled for filling trench holes according to claim 11, wherein said front guide pivots on said sled to a second position that raises said front guide above said street or road.

13. The slurry sled for filling trench holes according to claim 11, wherein said front guide is changeable or replaceable to correspond to a width of a trenched hole or slot.

14. The slurry sled for filling trench holes according to claim 11, wherein said front hinges on a barrel pin.

15. The slurry sled for filling trench holes according to claim 1, wherein said front guide tracks a front of said sled.

16. The slurry sled for filling trench holes according to claim 1, wherein said elongated bottom opening is a removable chute that is interchangeable.

17. The slurry sled for filling trench holes according to claim 16, wherein said elongated bottom opening is changeable or replaceable to correspond to a width of said open trenched hole.

18. The slurry sled for filling trench holes according to claim 16, wherein said elongated bottom opening is compliantly mounted within said sled.

19. The slurry sled for filling trench holes according to claim 1, wherein said sled further includes a multipurpose platform.

20. The slurry sled for filling trench holes according to claim 19, wherein said sled multipurpose platform is configured to retain a generator that powers a vibrator.

* * * * *